US005314169A

United States Patent [19]

Kamlani et al.

[11] Patent Number: 5,314,169

[45] Date of Patent: May 24, 1994

[54] METHOD AND APPARATUS FOR HEAT TREATING ELONGATE METALLIC PRODUCTS

[75] Inventors: Vijay M. Kamlani, Holland; Otakar A. Kuby, Toledo; Walter J. Operacz, Sylvania, all of Ohio; Frank J. Vereecke, Palmyra, Mich.

[73] Assignee: A. C. Leadbetter & Son, Inc., Toledo, Ohio

[21] Appl. No.: 935,827

[22] Filed: Aug. 26, 1992

[51] Int. Cl.[5] ..... C21D 9/00

[52] U.S. Cl. ..... 266/105; 266/274

[58] Field of Search ..... 266/102, 103, 105, 249, 266/252, 259, 274

[56] References Cited

U.S. PATENT DOCUMENTS

| | | | |
|---|---|---|---|
| 2,327,734 | 8/1943 | Morgan | 266/259 |
| 3,852,989 | 12/1974 | Harada et al. | 266/259 |
| 3,892,391 | 7/1975 | Okuno | 266/259 |
| 3,957,111 | 5/1976 | Kobayshi et al. | 266/259 |
| 4,282,048 | 8/1981 | Zentner | 148/155 |
| 4,382,586 | 5/1983 | Reece | 266/259 |
| 4,441,698 | 4/1984 | Limque et al. | 266/274 |
| 4,469,314 | 9/1984 | Takeuchi et al. | 266/252 |
| 4,982,934 | 1/1991 | Bonino et al. | 266/105 |

*Primary Examiner*—Scott Kastler

*Attorney, Agent, or Firm*—Willian Brinks Hofer Gilson & Lione

[57] ABSTRACT

Spaced apart packs of closely spaced steel or other metallic rods, tubes or other elongate articles are annealed or otherwise heat treated by advancing them step by step by a walking beam mechanism through a chamber having a series of independently temperature controlled zones along the path of travel, the articles being disposed horizontally and transversely of the path of travel. The atmosphere within each zone is recirculated therein independently of the recirculation of atmosphere within adjacent zones and without substantial mixing of the atmosphere within adjacent zones. Packs are introduced into the chamber from a bed of powered rollers adjacent to the inlet end of the chamber partly by pivoting the free ends of extensions of the movable rails of the walking beam mechanism, to lift a pack above the level of the powered rollers so that it can translate with the other packs within the chamber, and partly by pusher heads which slidably engage the movable rail extensions and which are reciprocable with respect thereto. The chamber is preferably utilized to process articles which retain a significant degree of latent heat from a manufacturing or other processing operation to avoid the need for a significant degree of reheating of the articles within the chamber and without substantial intermixing of the atmosphere from adjacent zones.

20 Claims, 12 Drawing Sheets

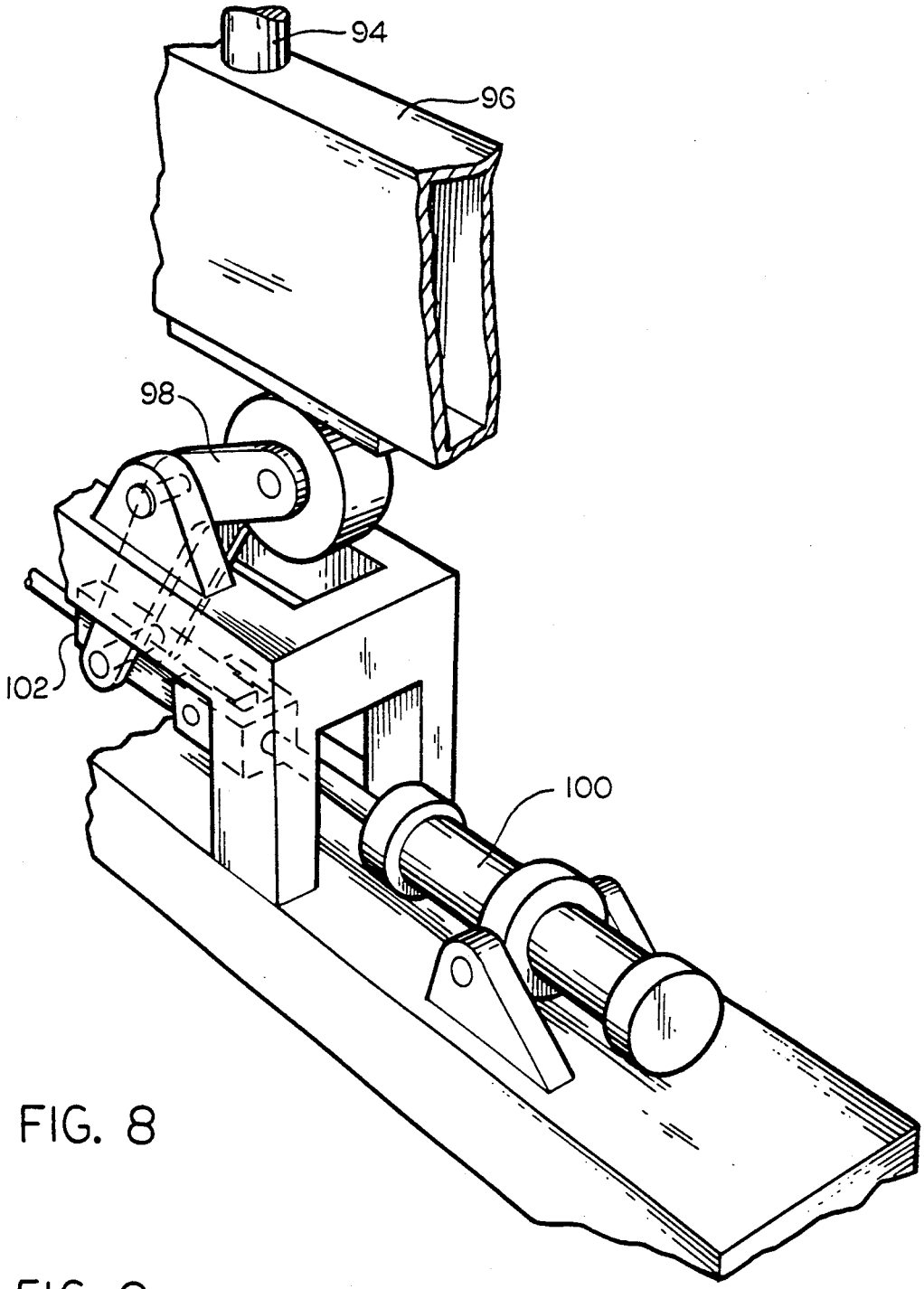
FIG. 8
FIG. 9
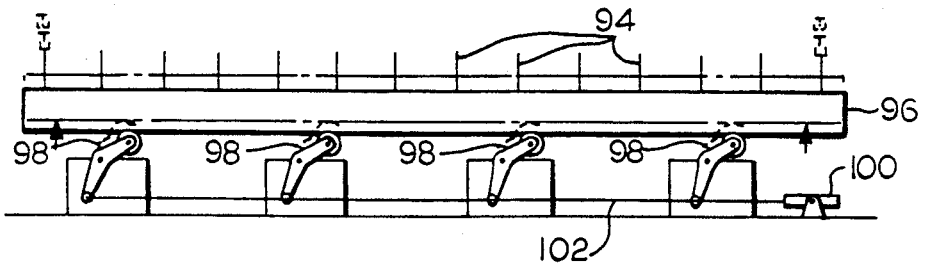

METHOD AND APPARATUS FOR HEAT TREATING ELONGATE METALLIC PRODUCTS

BACKGROUND OF THE INVENTION

This invention relates to a method and apparatus for continuously heat treating elongate metallic products, such as steel bars and tubes. More particularly, this invention relates to the annealing of elongate steel products, such as bars and tubes, by passing heated products from a rolling mill through an enclosed furnace or chamber, after arranging the products in dense packs, to provide the shapes with a predetermined time versus temperature thermal history. The shapes are advanced through the chamber along a horizontal path that extends transversely of the longitudinal axes of the shapes to maintain proper control of the end to end temperature of each product.

Steel products, for example, steel bars and tubes from a rolling mill, are cooled from the rolling mill temperature to a final handling temperature according to some time versus temperature pattern, the nature of which will have an effect on the final properties of the products. As is understood in the art, hot rolled iron-based alloy products, such as steel bars and tubes, are normally gradually cooled from the rolling mill temperature, which is typically 1700° F. to 1800° F. for the various grades of steel that are widely used in steel bars and tubes for the construction industry. However, it has been found that beneficial properties for certain applications may be imparted to hot rolled steel bars and tubes by providing them with a prolonged residence time at a temperature of approximately 1050°-1300° F., during which residence time the temperature is closely controlled, for example, a temperature controlled to a predetermined temperature ±25° F. within such range, a process which has the effect of annealing the steel products.

As may be clear from the foregoing, the critical temperature for proper annealing of a steel article is well below the temperature at which the article is formed by rolling, casting or the like. Thus, if the article is transferred to the annealing chamber rather quickly after it is formed, it will be at a sufficiently high temperature when it begins the annealing cycle to avoid the need to reheat it to its proper annealing temperature, and in this case there will thereby be effected a significant reduction in energy consumption. To achieve this, however, it is necessary to transfer the formed steel products from the forming station to the annealing chamber after cooling them to a suitable annealing temperature after a time period determined by a time calculation model and at a controlled rate. Annealing of steel products while they still retain significant heat from a forming operation, and therefore without requiring that the products be reheated to any substantial degree, will also serve to reduce the required size of the annealing chamber, and consequently the required cost thereof.

Because of the long soak cycle required for proper annealing of steel products, as explained above, a continuous furnace or other controlled temperature chamber for such purpose, namely a chamber where the products to be annealed are introduced at one end and are removed from an opposed end after being slowly advanced through the chamber, is ordinarily quite long to provide adequate residence time for the products. Thus, such a chamber is quite expensive in terms of its investment costs and occupies a great deal of valuable floor space in a mill or factory where it is to be installed. Further, in certain cases, for example, in an existing mill or factory where an existing annealing chamber is to be replaced, adequate floor space simply may not be available to install a conventional annealing chamber of adequate capacity simply because of the heretofore required spacing between like bars or other elongate products as they progress through the annealing chamber to provide proper temperature uniformity and distribution within the chamber.

SUMMARY OF THE INVENTION

In accordance with the present invention, there is provided a method and apparatus for heat treating elongate metallic products, such as steel bars and tubes, in which the products leave a forming station at an elevated temperature along a flow path extending along the longitudinally extending axes of the products after the products have been severed into individual lengths from a continuous length by a hot shear device. After a preliminary cooling step in which the products are cooled from their forming temperature to a lower, but still elevated, temperature by advancing them horizontally along an open cooling bed at a predetermined speed for each particular product such as to obtain a fixed entry temperature, and in a direction extending transversely of the longitudinal axes of the products, the products are formed into dense packs of several closely spaced products in each pack by suitable devices which may be incorporated into an otherwise conventional open cooling bed, and the packs are then rapidly and serially transferred into an enclosed annealing furnace or chamber through an opening at an inlet end of such chamber. Treatment of steel bars and tubes according to the method and apparatus is useful in improving the cold shearability of the products.

The annealing chamber of the present invention is subdivided into a plurality of zones extending along a path of travel of the packs through the chamber, and each zone has an air or other suitable atmosphere recirculating system for circulating the atmosphere within such zone to provide temperature uniformity within the zone and to maintain an acceptable rate of heat transfer between the atmosphere and the products within the zone by way of convection and radiation heat transfer. Further, each zone is provided with a separate temperature control system for maintaining a suitable atmosphere temperature within such zone, including automatically modulated operated heating or cooling devices to increase or decrease the temperature of the recirculating atmosphere, as required.

Spaced apart packs of bars or tubes are positioned horizontally within the annealing chamber and are advanced through the annealing chamber along a horizontal flow path that extends transversely of the longitudinal axes of the products. In this way, the entirety of each product is positioned within one or another of the individual controlled temperature zones, to provide maximum end to end temperature uniformity of each bar. Further, the transferring of the packs of products through the furnace is accomplished by a walking beam mechanism. Such a mechanism is effective to advance the packs of bars in precise increments of travel without the need to push on the bars in a direction extending along the path of travel, which would require bar to bar contact throughout the annealing chamber and which could lead to skewing of the bars within the chamber and/or scratching of the surfaces of the bars.

Accordingly, it is an object of the present invention to provide an improved method and apparatus for heat treating elongate metallic shapes. More particularly, it is an object of the present invention to provide an improved method and apparatus for annealing steel bars and tubes. Even more particularly, it is an object of the present invention to provide a method and apparatus for annealing steel bars and tubes in an annealing facility of reduced size and reduced floor space requirements. It is also an object of the present invention to provide a method and apparatus for annealing steel bars and tubes in which the bars and tubes are annealed while still retaining sufficient heat from a forming operation to thereby avoid the need for any significant degree of reheating to accomplish proper annealing. It is also an object of the present invention to provide an improved apparatus for introducing elongate articles into a treatment chamber along a path of flow extending transversely of the longitudinal axes of the articles.

For a further understanding of the present invention and the objects thereof, attention is directed to the drawing and the following brief description thereof, to the detailed description of the preferred embodiment, and to the appended claims.

BRIEF DESCRIPTION OF THE DRAWING

FIG. 8 is a fragmentary perspective view of a mechanism for operating a lifting mechanism for the charging rail of the apparatus depicted in FIGS. 2-6;

FIG. 9 is a schematic view of the mechanism of FIG. 8;

DETAILED DESCRIPTION OF THE PREFERRED EMBODIMENT

Figure 1:
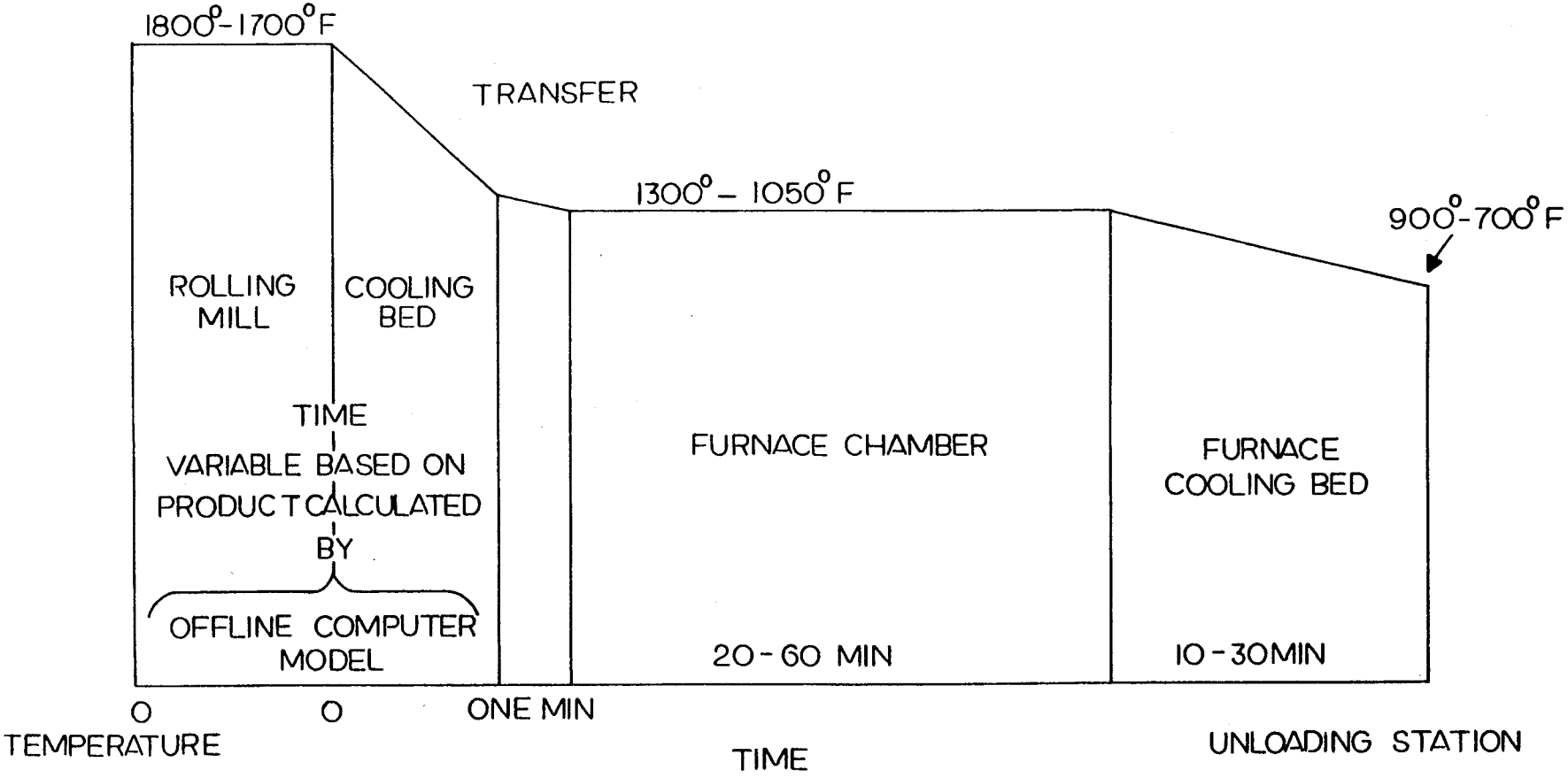
FIG. 1 is a graph of a typical time vs. temperature for steel bars and tubes when given a thermal history according to the method and apparatus of the present invention.

As shown in FIG. 1, steel bars and tubes leave a hot rolling mill at a temperature of 1800°-1700° F., at which temperature they are severed into individual products of a predetermined length by a hot shear device, which may be any of a variety of known prior art types of hot shear devices. The individual bars or tubes, which can vary in length from one batch to another but which are usually uniform in length within each batch, are then cooled to a temperature which is slightly above a suitable temperature for annealing, by advancing them across an open cooling bed, usually in groups of bars or tubes that are produced from a single steel billet. Various types of cooling beds are known in the prior art, and may be used to partly cool bars and tubes to prepare them for processing according to the present invention, except that the prior art cooling beds are usually designed to cool bars and billets to a final, suitable handling temperature, and must be modified to provide collecting cradles or other handling means to intercept the bars or billets before they complete a path of travel along the open cooling bed for transfer to a closely temperature controlled chamber, which is generally indicated by reference numeral 20, for further processing according to the present invention.

After the partial cooling step on the open cooling bed, the bars or tubes in spaced apart packs of such bars or tubes are rapidly transferred to minimize further cooling during the transfer step, for example, in a period of time of approximately 1 minute, pack by pack, for further processing within the chamber 20 where they are maintained at a controlled temperature, for example a temperature in the range of 1300° F.-1050° F., for a suitable length of time, for example, for 20-60 minutes, a process which will result in the annealing of the bars or tubes. At the conclusion of such annealing cycle, the bars or tubes are then cooled to a suitable temperature for final handling, for example, a temperature in the range of 900°-700° F., and this cooling step may be performed or partly performed within the chamber 20. If this further cooling step is performed at least partly outside the chamber 20, a downstream open cooling bed may be provided to permit the bars or tubes to complete the cooling cycle to the final desired handling temperature.

Figure 4:
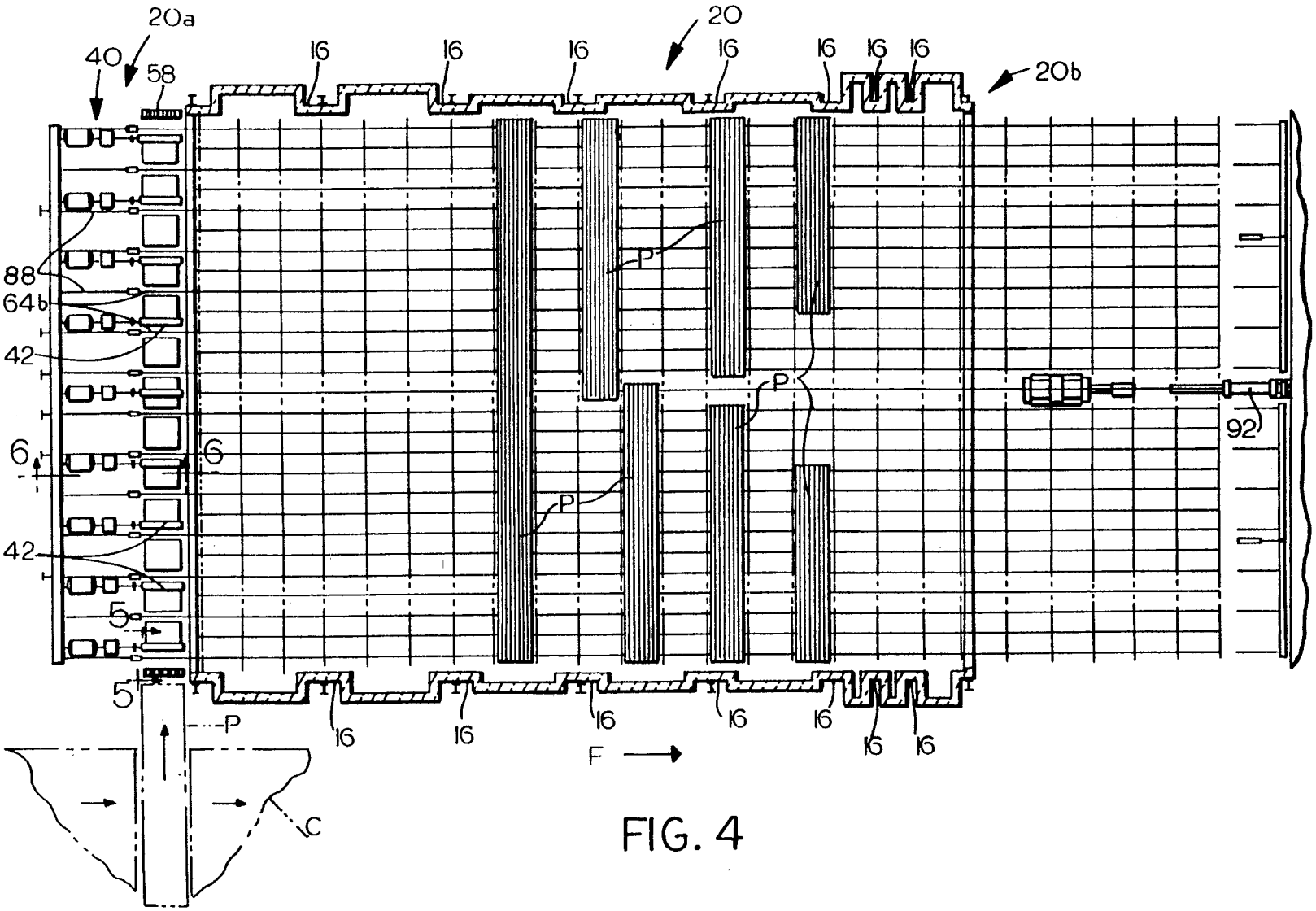
FIG. 4 is a sectional view taken on line 4—4 of FIG. 3.
Figure 11:
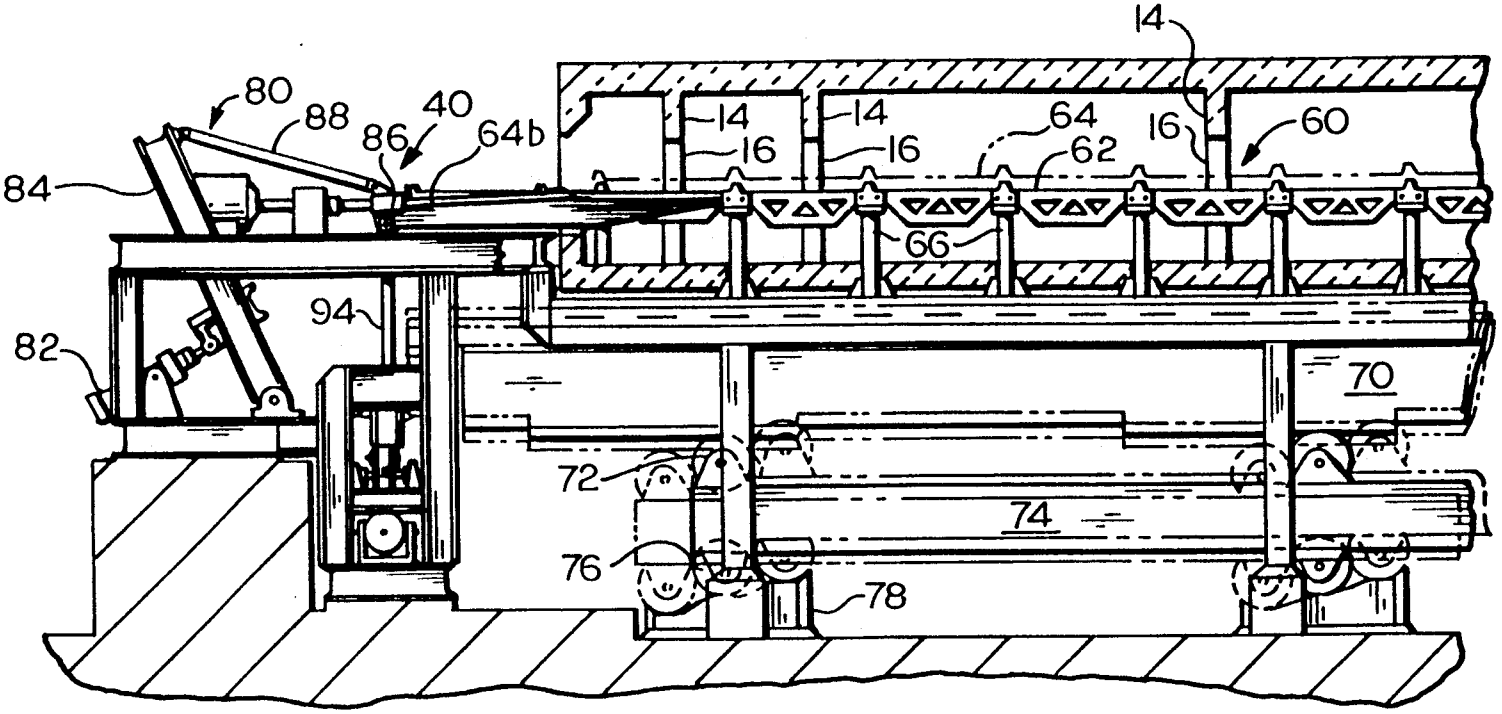
FIG. 11 is a fragmentary view similar to FIG. 7, but at a somewhat reduced scale, illustrating the apparatus of FIG. 7 in its relationship to other portions of the annealing facility of FIGS. 2-6.
Figure 12:
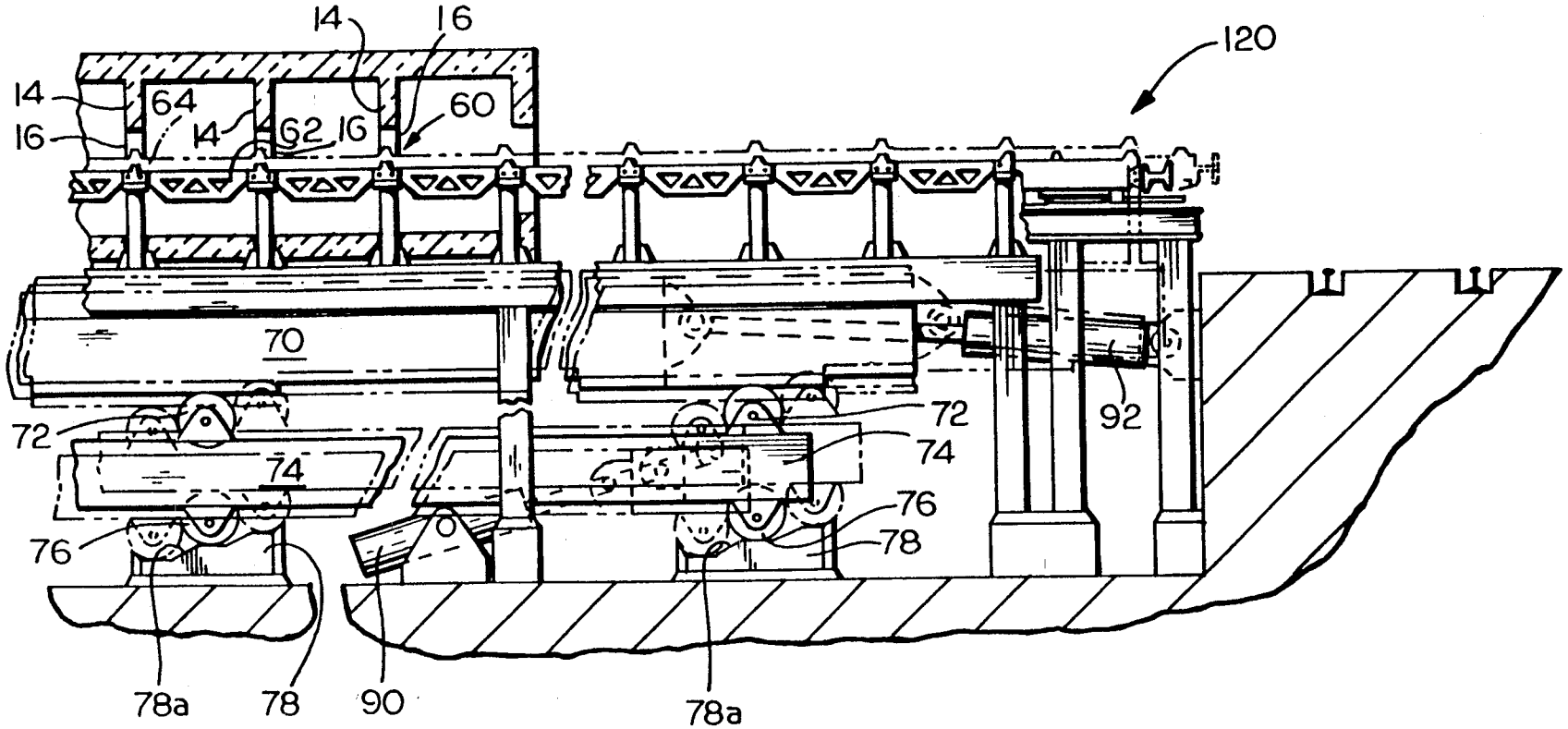
FIG. 12 is a view similar to FIGS. 7 and 11 but of the outlet end of the annealing facility of FIGS. 2-6.
Figure 13:
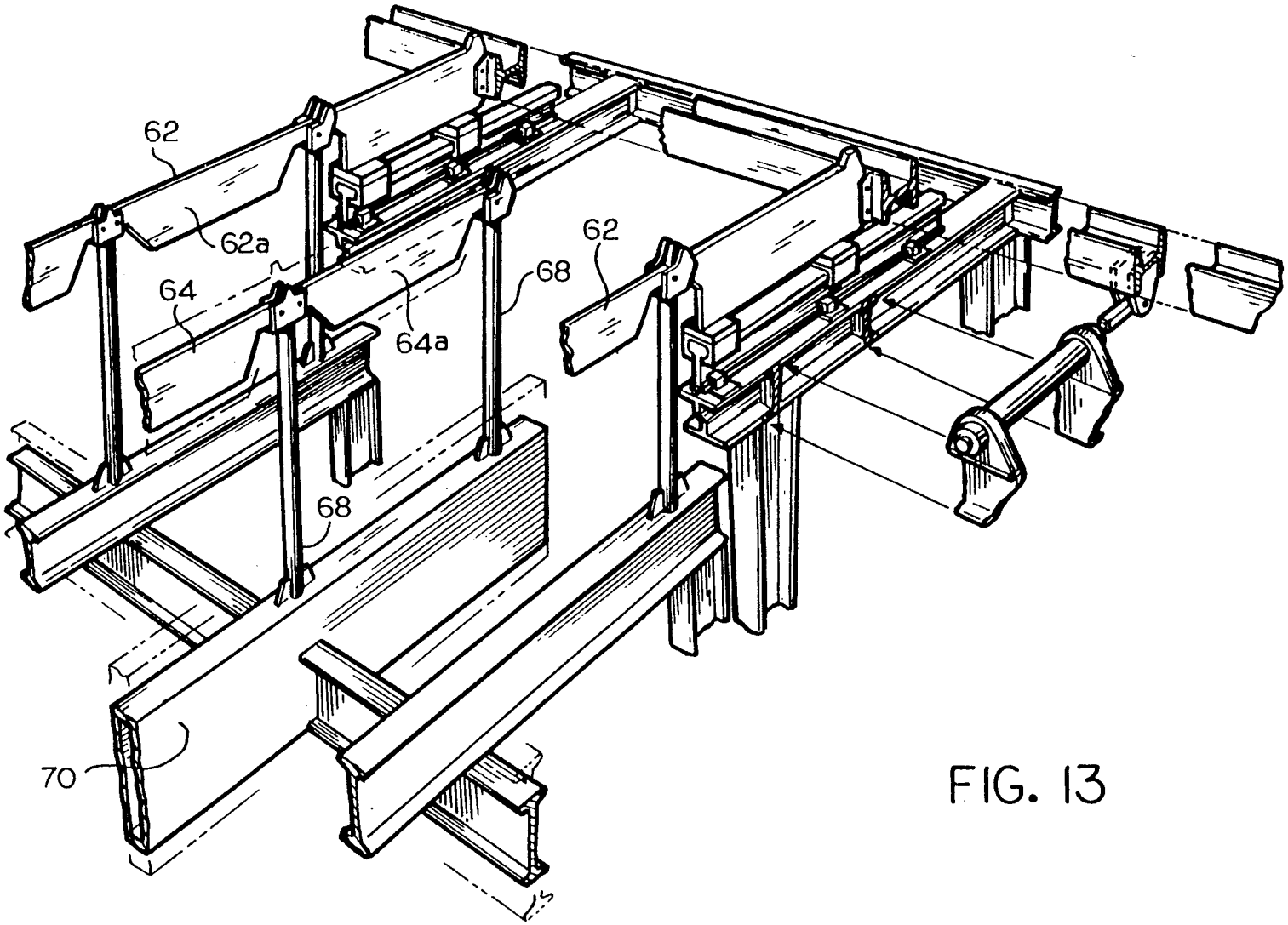
FIG. 13 is a fragmentary perspective, partly exploded, view of portions of the walking beam mechanism of the annealing facility of FIGS. 2-12.

Spaced apart packs P of multiple elongate metallic articles with parallel longitudinal axes, for example, steel bars or tubes, FIG. 4, are introduced through an opening in an inlet end **20*a* of the annealing chamber 20 to be slowly transferred along a horizontal flow path F extending transversely of the horizontally extending longitudinal axes of the individual bars or tubes in each pack P toward an outlet end 20*b*. The annealing chamber 20, which is suitably insulated using heat treat furnace construction techniques for operation at a suitable annealing temperature for the metal in question, is provided with a plurality of individual zones extending along the flow path F. As illustrated, the annealing chamber 20 is provided with eight zones, as indicated by recirculating blowers 22, 24, 26, 28, 30, 32, 34, 36, respectively. Each of the blowers 22, 24, 26, 28, 30, 32, 34, 36 is connected by suitable ductwork to an inlet opening into the annealing chamber 20 on one side 20*c* thereof and to an outlet opening on the other side 20*d* thereof for continuous circulation of the heated atmosphere within each zone from one side to the other thereof. The side to side circulation of atmosphere within the chamber 20 serves to maintain a relatively uniform temperature within each zone, to utilize connective and radiative heat transfer to heat or cool the bars or tubes within each pack P within such zone, as required for proper heat treatment thereof, and to minimize the mixing of atmosphere within a given zone with atmosphere in adjacent zones. Further, the sides of the chamber 20 are provided with inwardly projecting pilasters 10 between the zones to minimize zone to zone mixing of atmosphere within the chamber 20. This effect is further enhanced by providing the top of the chamber 20 with downwardly depending baffles 14 between at least some of the zones as is shown in FIGS. 11 and 12. The construction of the chamber 20, as described, lends itself to control by a control program which can accurately take into account a wide variety of process variables including product size and configuration, composition of material, finishing temperature, processing temperature, required annealing temperature, chamber capacity and required production rate to select and control and proper temperature for the products entering the chamber 20**.

Each of the zones of the annealing chamber 20 is provided with a temperature control system, not shown, for accurately controlling the temperature within such zone relatively independently of the temperatures within adjacent zones, together with a suitable heating and/or cooling device 18 to heat or cool the recirculating atmosphere within such zone, as required for close control of the temperature within the zone. Thus, the bars or tubes in each of the packs P can be given a carefully controlled thermal history for proper metallurgical properties as they pass through the chamber 20 from the inlet end 20*a* to the outlet end 20*b* thereof. By the annealing of the individual bars or tubes in packs of closely spaced bars or tubes, as opposed to doing so in an arrangement where the bars or tubes are uniformly spaced apart from one another along the flow path F, each of the bars or tubes can be provided with sufficient time in residence within the annealing facility for proper heat treatment without requiring that the length of the annealing facility be inordinately long. In that regard, the individual articles in each pack P are preferably spaced in article to article contact.

Figure 2:
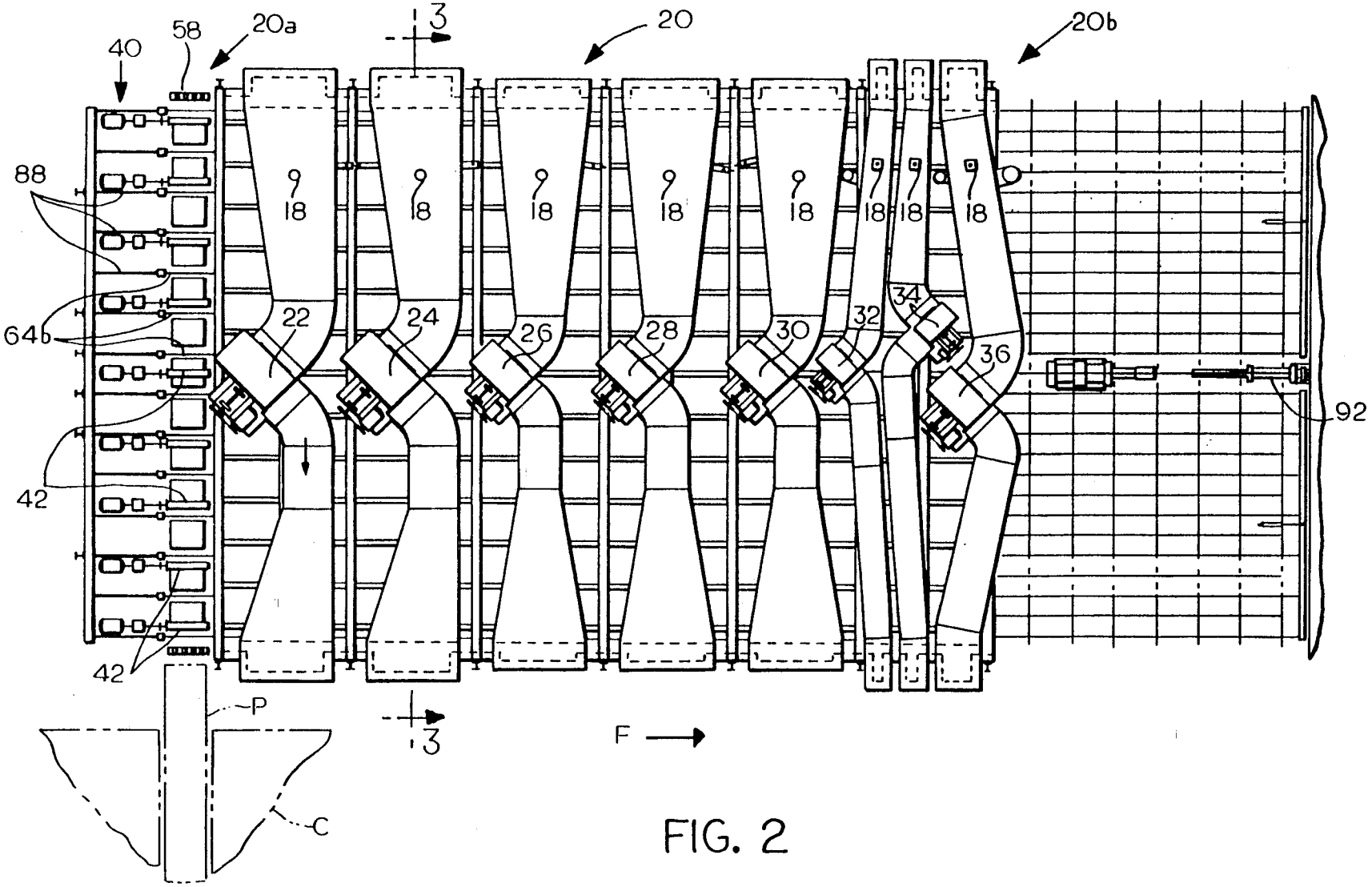
FIG. 2 is a plan view of an annealing facility according to a preferred embodiment of the present invention.

The packs P are transferred in sequence to the inlet end 20*a* of the annealing chamber 20 along a horizontal flow path that extends transversely of the flow path F from an open cooling bed C, which is shown fragmentarily in broken line in FIGS. 2 and 4, along a roller bed which is indicated generally by reference numeral 40. If the cooling bed C is a typical prior art cooling bed, it may be necessary to intercept the bars or tubes before they complete their path of travel across such cooling bed by providing special collecting cradles to collect the bars or tubes into a pack and elevating rolls to elevate the packs to a suitable elevation for processing with the chamber 20, namely the level of the roller bed 40.

Figure 6:
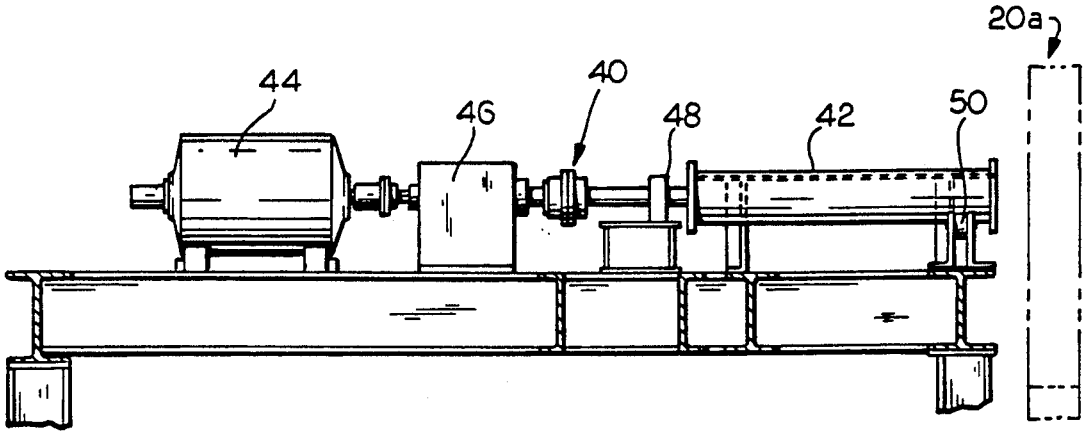
FIG. 6 is a sectional view, at an enlarged scale, taken on line 6—6 of FIG. 4.
Figure 5:
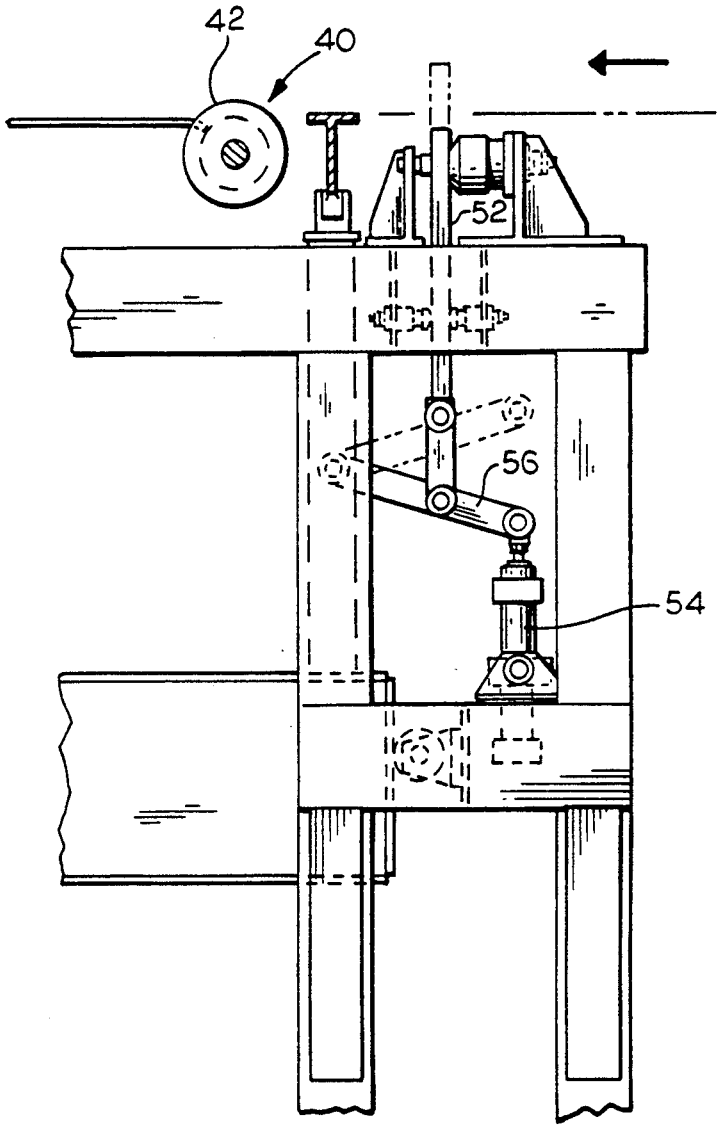
FIG. 5 is a sectional view, at an enlarged scale, taken on line 5—5 of FIG. 4.

The roller bed 40 is made up of a series of spaced apart, like, parallel rollers 42 which are positioned adjacent to the inlet end 20*a* of the annealing chamber 20 with the longitudinal axes of rotation of the rollers 42 being co-planar and extending parallel to the flow path F. As is shown most clearly in FIG. 6, each of the rollers 42 is driven by an electric motor 44 through a suitable speed reducer 46, and each of the rollers is rotatingly supported at its opposed ends by spaced apart bearings 48, 50. The admission of a fresh pack P to the roller bed 40 is selectively permitted or prevented by a vertically reciprocable gate 52, FIG. 5, which is actuated by a pneumatic or hydraulic cylinder 54 through a second class lever arm 56 to shorten the stroke of the gate 52 in relation to the stroke of the cylinder 54. A fixed stop 58 is provided at the end of the roller bed 40 which is remote from the location of the gate 52 to limit the travel of each of the packs P along the roller bed 40. When small packs P are to be introduced into the annealing chamber 20, for example packs of bars or tubes from a small billet, a plurality individual packs P in succession are advanced along the roller bed 40 until all of the packs P on the roller bed 40 are ready to be introduced together, into the chamber 20. To minimize heat loss from the chamber 20 through the inlet end 20*a*, preferably the opening in the inlet end and 20*a* through which the packs P are introduced is at least partly closed by a heat resistent flexible curtain, not shown.

Figure 7:
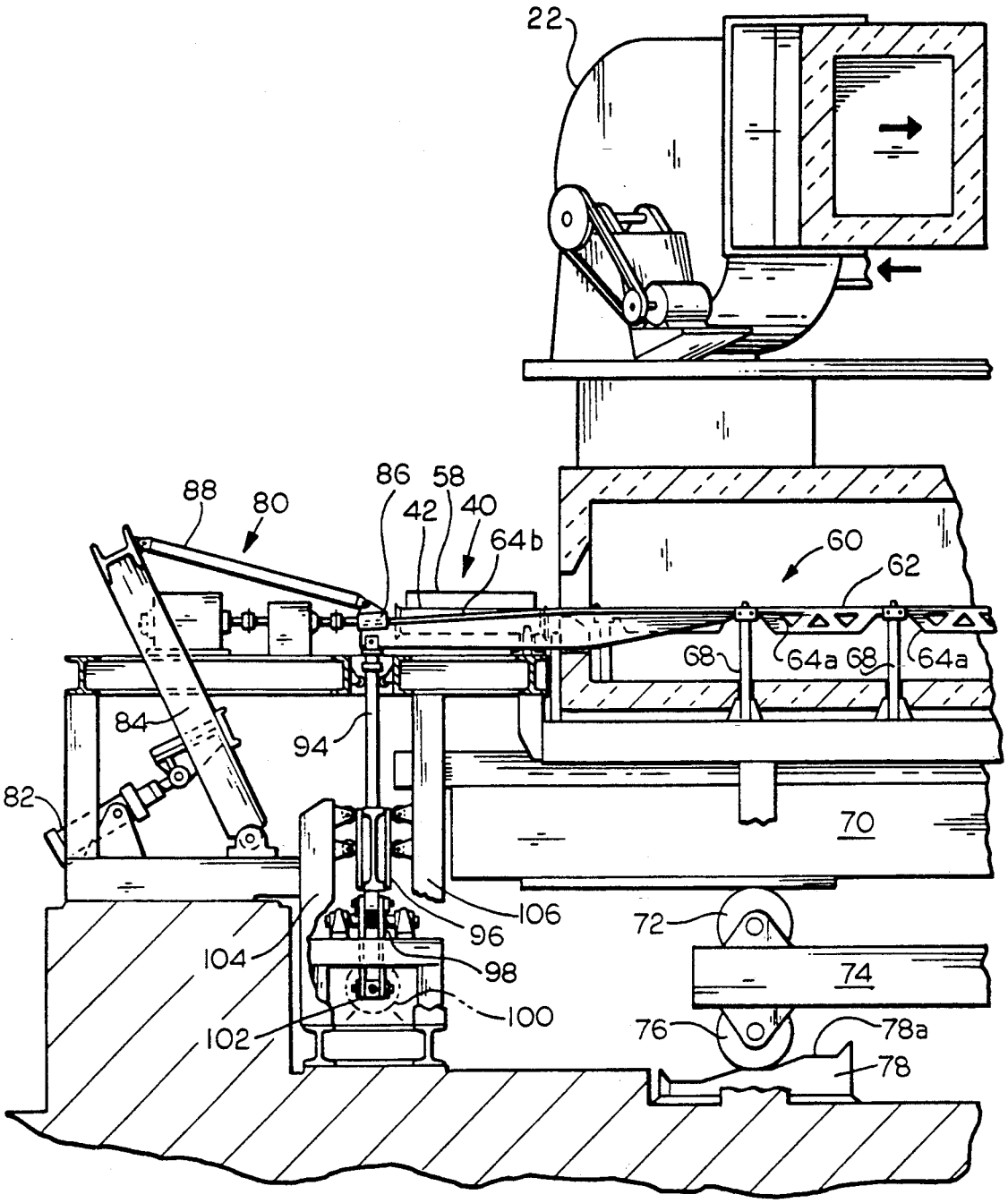
FIG. 7 is a fragmentary elevational view, partly in cross-section, of the inlet end of the annealing facility of FIGS. 2-6.

The annealing chamber 20 is provided with a generally horizontally extending hearth, indicated generally by reference numeral 60, which is aligned with the tops of the rollers 42 of the roller bed 40 and which is positioned above an insulated bottom portion 20*e* of the annealing chamber 20. When the chamber 20 is ready to receive a fresh pack P for processing therein, (or an end to end series of fresh packs P) the pack(s) P is advanced from the roller bed 40 into the chamber 20 by a pusher mechanism, indicated generally by reference numeral 80, which is positioned adjacent to the roller bed 40, as is illustrated in FIGS. 7 and 11. The pusher mechanism 80 includes a pneumatic or hydraulic cylinder 82 which acts as a moving fulcrum against a second class lever arm 84 to advance a pusher head 86 and thereby advance a pack P into the chamber 20 by a distance which is greater than the stroke of the cylinder 82. Each pusher head 86 is pivotally attached to an end of an arm 88, the other end of which is pivotally attached to the upper end of the lever arm 84. The elevation of the pusher head 86 is beneath that of the roller bed 40 when the pusher head is in its retracted position, but is elevated so that it can engage a pack P on the roller bed 40 before it is advanced, as will be hereinafter explained more fully.

The hearth 60 is made up of a series of spaced apart, coplanar fixed rails 62 interleaved with a series of spaced apart, coplanar movable rails 64 whose top surfaces are normally positioned at the same elevation as the top surfaces of the fixed rails 62 in a first position of the movable rails 64, so that the packs P are normally supported by both sets of rails 62, 64, and above the plane of the top surfaces of the fixed rails 62 in a second position of the movable rails 64. The fixed rails 62, each of which preferably is made up of a plurality of fixed rail segments 62*a*, joined in an end to end fashion, are supported above the level of the insulated bottom 20*e* of the facility 20 by a series of vertically extending posts 66, a post 66 being positioned between and supporting the adjacent ends of each adjacent pair of fixed rail segments 62*a*. The movable rails 64, each of which is preferably made up of a plurality of movable rail segments 64*a*, joined in an end to end fashion, are supported by vertical supports 68, a post 68 being positioned between and supporting the adjacent ends of each adjacent pair of fixed rail segments 64*a*. Each of the rail segments 62*a*, 64*a* is preferably constructed with vertical webs with openings extending therethrough to provide good atmosphere flow characteristic in the chamber 20 below the level of the packs P. The vertical supports 68, in turn, are supported by a generally horizontally extending frame 70, and the frame 70 is rollingly supported on rollers 72 which are rotatingly affixed to the top of a second frame 74. The second frame 74 also has rollers 76 rotatingly affixed to the bottom thereof, and the rollers 76, in turn, rotatingly engage the upper cam surfaces 78*a* of fixed cams 78.

When it is desired to advance the packs P on the hearth 60 within the chamber 20, and all the packs P are advanced simultaneously, the second frame 74 is advanced toward the outlet end 20*b* of the chamber 20 by actuating an hydraulic cylinder 90, FIG. 12, whose rod end is pivotably attached to the frame 74. In advancing the frame 74 toward the outlet end 20*b* in this manner, the frame 74 will also rise because of the configuration of the surfaces 78*a* of the cams 78, and the frame 72, in turn, will also rise, but not translate at this time, thereby raising the level of the movable rails 64 and the packs P above the level of the fixed rails 62. After the movable rails 64 have been elevated by the translation of the frame 74, as heretofore explained, and before a reverse translation of the frame 74, the frame 70 is caused to translate toward the outlet end 20*b* of the chamber 20 by the retraction of an hydraulic cylinder 92, FIG. 12, which is positioned at the outlet end 20*b* of the chamber 20 and whose rod end 70 is pivotably attached to the frame 70. After the packs P have been advanced toward the outlet end 20*b* of the chamber 20 by the sequential operation of the cylinders 90 and 92, as described, a sequence which will result in the advancement of each of the packs P by a very precisely controllable amount without any pack to pack contact, the sequence is reversed to return the frame 70 to its start position to await the next forward step of the packs P. Thus, after completion of a forward step of the packs P as described, the cylinder 90 is retracted to lower the frame 74, and thus the frame 72, so that the movable rails 64 are now below the level of the fixed rails 62 and each of the packs P within the chamber is again resting on the fixed rails 62, but at a location closer to the outlet end 20*b* of the chamber 20 by a distance which is equal to the width of a pack plus the width of a space between adjacent packs. Then the cylinder 92 is advanced to translate the frame 72 back to its start position.

Figure 10:
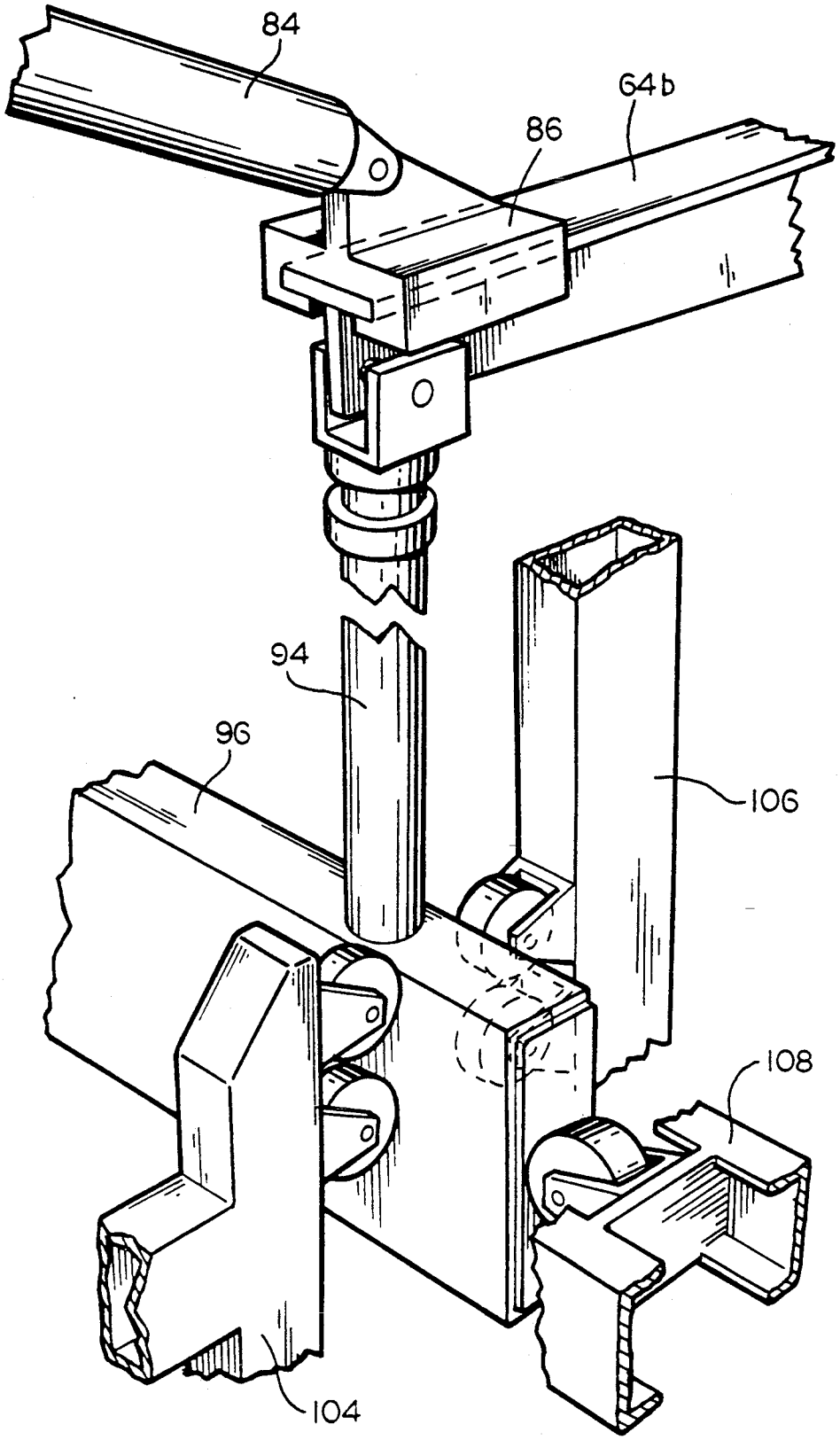
FIG. 10 is a fragmentary perspective view, at an enlarged scale, of a portion of the apparatus depicted in FIG. 7.

To facilitate the introduction of a pack P into the inlet end 20*a* of the chamber 20, each of the movable rails 64 is provided with an extension 64*b* which extends from the first segment 64*a* at the inlet end 20*a* of the chamber 20 outwardly from the chamber 20 to a location aligned with the roller bed 40. The leading ends of the extensions 64*b* are pivotably supported at the tops of vertically extending rods 94, FIG. 10, which are supported on a common beam 96. The beam 96 is caused to raise and lower by the action of a plurality of cranks 98. The cranks 98, in turn, are operated in unison by a rod 102 which is actuated by a hydraulic cylinder 100. The rest or home position of the beam 96 positions the tops of the extensions 64*b* beneath the tops of the rollers 42 of the roller bed 40. When the hydraulic cylinder 100 is actuated to raise the beam to its uppermost position, the tops of the extensions 64*b* will be above the tops of the rollers 42, and the pusher mechanism 80 is then actuated to move the pusher heads 86 along the extensions 64*b* to advance a pack P from the roller bed 40 into the inlet end 20*a* of the chamber 20. To facilitate the motion of each pusher head 86 along its extension 64*b*, as shown in FIG. 10, each pusher head 86 has the cross-section of a downwardly facing C and each extension 64*b* has the cross-section of an upright T, and the extension 64*b* is slidably engaged within the pusher head 86 such that the head of the T is within the interior of the C and the stem of the T extends downwardly through the opening in the C. Thus, the pusher heads 86 can move each pack P from the roller bed 40 far enough along on the extension 64*b* such that the next advance of the frame 70 will advance the pack P on the extensions 64*b* in step with the packs P on the sections 64*a* of the movable rails 64.

As is shown in FIG. 10, the movement of the beam 96 is restrained to vertical movement only by engaging each of its opposed ends in roller bearing guide supports 104, 106, 108, an opposed pair of guide supports, 104, 106, engaging opposed sides of the beam 96 and the other guide support, 108, engaging an end thereof.

Figure 3:
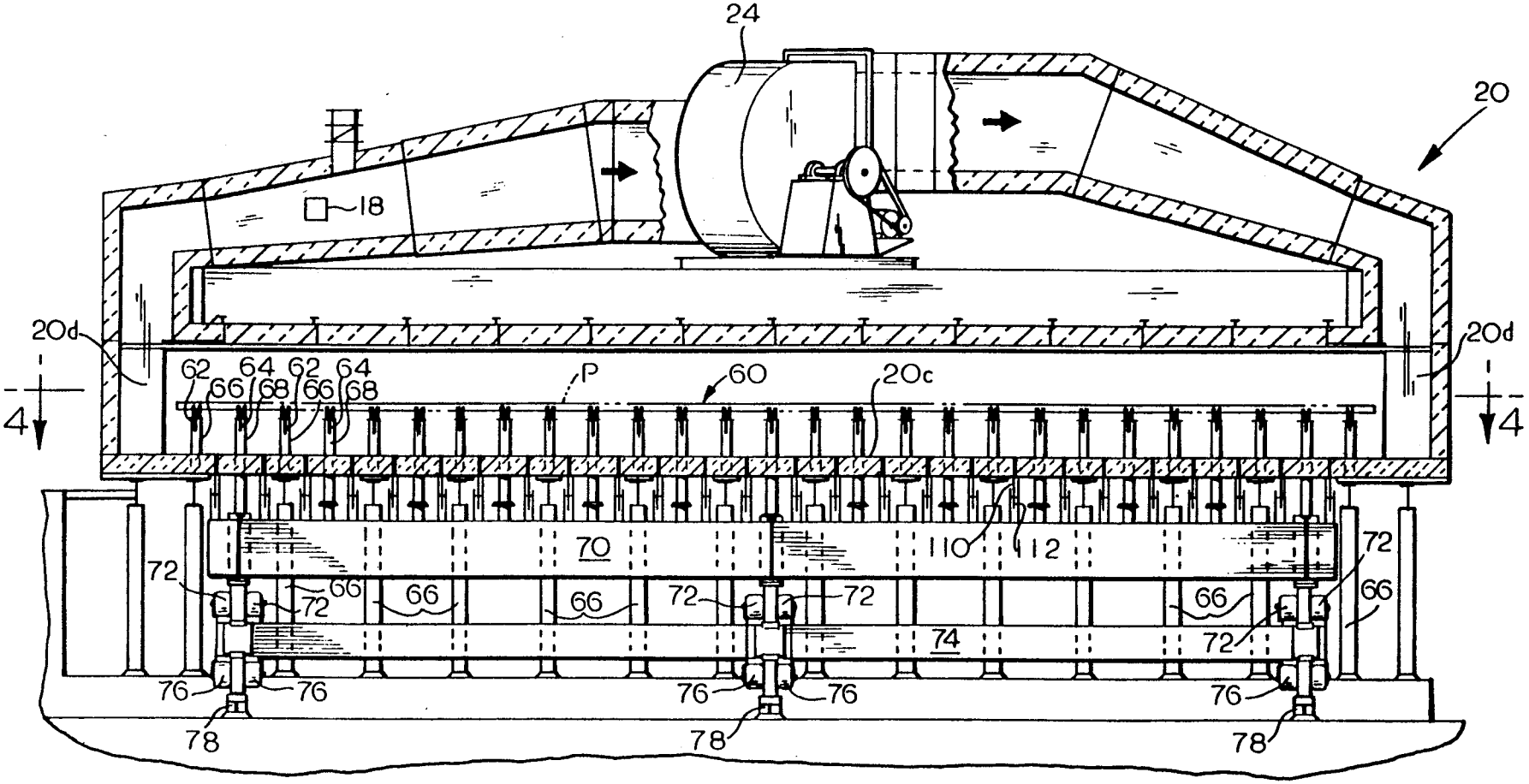
FIG. 3 is a sectional view taken on line 3—3 of FIG. 2.

As is shown in FIG. 3, every opening in the bottom 20*c* of the chamber 20 is provided with a water seal, in the form of a thin plate 110 which extends down below the level of water in an upwardly facing, water containing U-shaped trough 112. This prevents the entry of cold atmosphere into the chamber 20 in spite of the natural tendency for such entry to occur because of the natural stack effect of the chamber 20.

As is shown in FIGS. 2, 4 and 12, the beams 62 and 64 extend somewhat beyond the outlet end 20*b* of the chamber 20 to provide for any final desired air cooling of the packs P and to position each of the packs at a pack transfer station 120 for removal from the annealing facility. The details of construction of the apparatus at the pack transfer station 120 do not form a part of the present invention. However, it is contemplated that the pack transfer apparatus may be an electromagnetic device suspended from an overhead crane. In this case, the last group of rail segments should be constructed from a low magnetic permeability material.

In the operation of the chamber 20, typically the first zone, the zone serviced by the blower 22, serves to bring the articles within the packs P to a relatively uniform temperature to ensure proper annealing. Annealing then takes place in the next four to seven zones, namely those serviced by the blower 24, 26, 28 and 30, 32, 34 or 36. Any zones of the chamber 20 beyond that serviced by the blower 30 not required to complete the desired annealing cycle can be utilized for a controlled cooling of the articles being processed within the chamber.

Figure 14:
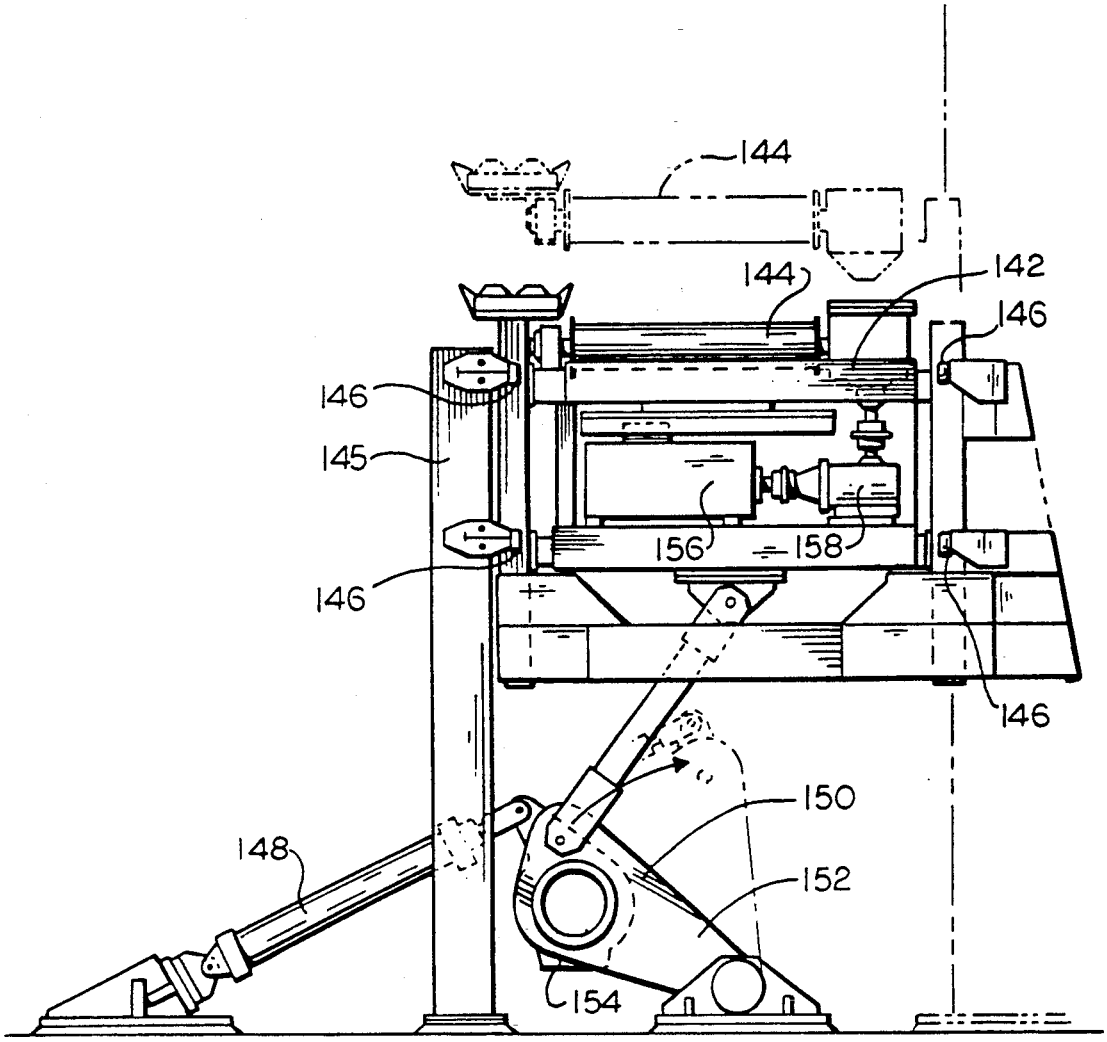
FIG. 14 is a fragmentary cross-sectional view of an elevating roll assembly for use with an open bed assembly to ensure that articles being processed on the open bed are properly presented to the annealing facility of FIGS. 2-13.

The elevating roll assembly of FIG. 14 includes a frame 140 which supports a roll carriage 142, each roll carriage supporting one or more horizontally extending rollers 144 and being restrained by guide rollers 146 so that the carriage 142 can only move vertically. The carriage 142 is caused to raise and lower by the action of a hydraulic or pneumatic cylinder 148 or other linear actuator which operates through a toggle linkage 150 whose bottom lever 152 is secured to a torque tube 154 to ensure that a plurality of like bottom levers 152 move in unison. Each roller 144 is powered by an electrical motor 156 acting through a drive mechanism 158. Actuation of the cylinder 148 ensures that a pack P of production on the rollers 144 will be positioned at a proper elevation to be transferred to the roller bed 40.

Although the best mode contemplated by the inventor(s) for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. Apparatus for heat treating elongate metallic articles, said apparatus comprising:

a chamber, said chamber having an inlet end with an opening therein and an outlet end spaced from said inlet end, said chamber being substantially enclosed and defining a substantially horizontal flow path for articles, the flow path extending from said inlet end to said outlet end, said chamber being divided into a series of zones extending along the flow path;

recirculating means associated with each of the zones for recirculating atmosphere within said each of the zones without substantial mixing of the atmosphere within said each of the zones with atmosphere from within adjacent zones;

temperature control means associated with each of the zones for maintaining a substantially uniform, predetermined temperature within said each of the zones;

means for forming a series of packs of the elongate metallic articles, the articles within each pack being spaced close to one another;

means for sequentially introducing packs into the chamber through the opening in the inlet end, each pack being positioned within the chamber with the articles extending generally horizontally and generally transversely of the flow path, the spacing between adjacent packs being greater than the spacing between adjacent articles in a pack; and means for advancing the packs within the chamber in unison in a step by step manner, without contact between adjacent packs, to sequentially remove packs from the chamber through the opening at the outlet end.

2. Apparatus according to claim 1 wherein said chamber comprises a generally horizontally extending bottom and wherein said means for advancing the packs further comprises means for supporting the packs above the level of the horizontally extending bottom.

3. Apparatus according to claim 2 wherein said means for supporting comprises a plurality of spaced apart fixed rail means, each of the fixed rail means extending generally parallel to the path of travel the plurality of fixed rail means being arranged in an array extending generally transversely of the path of travel.

4. Apparatus according to claim 3 wherein said means for advancing the packs further comprises:

a plurality of spaced apart movable rail means, each of the movable rail means extending generally parallel to the path of travel, the plurality of fixed rail means being arranged in an array extending generally transversely of the path of travel;

means for imparting vertical movement to the plurality of spaced apart movable rail means to lift a plurality of packs above the level of the plurality of fixed rail means; and means for imparting translating movement to the plurality of movable rail means to move each of the plurality of movable rail means from a first position to a second position while the plurality of packs thereon is above the level of the plurality of fixed rail means to move the packs by a step of a predetermined magnitude toward the outlet end of the chamber;

said means for imparting vertical movement further lowering the plurality of spaced apart movable rail means after the packs have been moved by the step so that the packs are again supported on the plurality of fixed rail means;

said means for imparting translating movement to the plurality of movable rail means further translating the plurality of movable rail means after the plurality of packs are again supported on the plurality of fixed rail means to return said each of the plurality of movable rail means from the second position to the first position.

5. Apparatus according to claim 4 wherein each of said spaced apart fixed rail means and each of said spaced apart moveable rail means has a generally vertically extending web, each said vertically extending web having at least one opening extending therethrough facilitate the flow of atmosphere within said chamber beneath the level of the packs therein.

6. Apparatus according to claim 1 wherein said means for sequentially introducing packs into the chamber comprises:

a plurality of spaced apart generally horizontally aligned rollers outside of the chamber and adjacent the inlet end, each of the rollers having a longitudinal axis of rotation extending generally parallel to the flow path; and means for sequentially transferring packs from the rollers into the chamber through the opening at the inlet end.

7. Apparatus according to claim 6 and further comprising:

drive means for rotating each of the rollers about its longitudinal axis of rotation.

8. Apparatus according to claim 7 and further comprising:

vertically reciprocable gate means at one side of the chamber and in alignment with the plurality of rollers for selectively permitting or preventing a pack of articles from entering onto the plurality of rollers; and means for reciprocating the vertically reciprocable gate means.

9. Apparatus according to claim 4 wherein said means for sequentially introducing packs into the chamber comprises:

a plurality of spaced apart, generally horizontally aligned rollers outside of the chamber and adjacent the inlet end, each of the rollers having a longitudinal axis of rotation extending generally parallel to the flow path;

an extension to each of said plurality of fixed rail means, each said extension having an inner end pivotably attached to one of the plurality of fixed rail means and being translatable therewith, each said extension further having an outer end generally aligned with said plurality of fixed rail means;

vertically reciprocable means pivotally connected to the outer end of each of said extensions for reciprocating the outer ends of the extensions between a first position beneath the level of the plurality of rollers and a second position above the level of the plurality of rollers, a pack of articles on the plurality of rollers being translatable with the plurality of movable rail means when said vertically reciprocable means is in its second position; and means for reciprocating said vertically reciprocable means.

10. Apparatus according to claim 9 wherein said means for sequentially introducing packs into the chamber further comprises:

a pusher head slidably engaging each of said extensions; and means for reciprocating each pusher head along its extension between a first position and a second position for advancing a pack along the plurality of extensions, when said vertically reciprocable means is in its second position, independently of the translation of the plurality of movable rail means.

11. Apparatus for introducing at least one elongate article into a treatment chamber through an opening in an inlet end of the treatment chamber for conveying in steps through the treatment chamber along a generally horizontal path of travel by the movement of a plurality of spaced apart movable rail means, each of the plurality of movable rail means extending generally parallel to the path of travel, the at least one elongate article extending generally horizontally and generally transversely of the path of travel, said apparatus comprising:

a plurality of spaced apart supports positioned outside of and closely adjacent to the inlet end of the chamber for receiving the at least one elongate article and supporting it in a position to be introduced into the chamber through the opening in the inlet end;

a plurality of movable rail extensions, each of said movable rail extensions having an inner end pivotally attached to one of said movable rail means and an outer end positioned between an adjacent pair of said spaced apart supports;

vertically reciprocable means for pivoting said plurality of movable rail means to move said outer end thereof between a first position which is beneath the level of the at least one elongate article on the plurality of spaced apart supports and a second position where said plurality of movable rail extensions support the at least one elongate article at a level above said plurality of supports, whereby the at least one elongate article will move with the plurality of movable rail means when the plurality of movable rail means moves; and means for reciprocating the vertically reciprocable means.

12. Apparatus according to claim 11 and further comprising:

a pusher head slidably engaging each of said movable rail extensions; and means for reciprocating each pusher head along its movable rail extension between a first position and a second position for advancing the at least one elongate article along the plurality of movable rail extensions when the vertically reciprocable means is in its second position independently of the movement of the plurality of movable rail means.

13. Apparatus according to claim 11 wherein said plurality of spaced apart supports comprises a plurality of generally horizontally aligned rollers, each of said rollers having a longitudinally extending axis of rotation which extends generally parallel to the path of travel.

14. Apparatus according to claim 13 further comprising:

drive means for imparting rotational movement to each of said rollers.

15. Apparatus according to claim 14 and further comprising:

vertically reciprocable gate means at one side of the treatment chamber and in alignment with the plurality of rollers for selectively permitting or preventing the at least one elongate article from entering onto the plurality of rollers; and means for reciprocating the vertically reciprocable gate means.

16. Apparatus according to claim 1 wherein said chamber has an opposed pair of spaced apart sides, and wherein said recirculating means comprises means for introducing atmosphere into each chamber at one of the sides and for withdrawing air from the chamber at the other of the sides, and further comprising pilaster means projecting inwardly from each of the sides at a location between at least one pair of adjacent zones of said chamber to physically retard the mixing of atmosphere within said pair of adjacent zones.

17. Apparatus according to claim 16 wherein said chamber further has a roof, and further comprising baffle means extending downwardly from said roof at a location between said at least one pair of adjacent zones to further physically retard the mixing of atmosphere within said pair of adjacent zones.

18. Apparatus according to claim 4 wherein said means for imparting vertical movement to the plurality of spaced apart movable rail means comprises;

a generally horizontally extending frame, a plurality of generally vertically extending supports supporting said spaced apart movable rail means above said generally horizontally extending frame, a second generally horizontally extending frame positioned beneath said generally horizontally extending frame;

roller means carried by said generally horizontally extending frame and rollingly supporting said generally horizontally extending frame on said second generally horizontally extending frame, a plurality of cams, each of said cams extending generally parallel to the path of travel and having an upper cam surface which is inclined in a direction extending upwardly from one of said inlet end and said outlet end to the other of said inlet and said outlet end, second roller means carried by said second generally horizontally extending frame and rollingly supporting said second generally horizontally extending frame on the upper cam surfaces of said plurality of cams, and means for translating said second generally horizontally extending frame with respect to said generally horizontally extending frame to move said second roller means along said direction relative to said cams.

19. Apparatus according to claim 18 wherein the upper cam surface of each of said cams comprises first and second upwardly inclined portions and a generally horizontally extending portion extending between said first and second upwardly inclined portions.

20. Apparatus according to claim 19 wherein the upper cam surface of each of said cams further comprises a second generally horizontally extending portion, said first upwardly inclined portion being positioned and extending between said second generally horizontally extending portion and said generally horizontally extending portion, and a third generally horizontally extending portion, said second upwardly inclined portion being positioned and extending between said generally horizontally extending portion and said third generally horizontally extending portion.

* * * * *